United States Patent [19]

Hemfort

[11] 3,990,632

[45] Nov. 9, 1976

[54] SELF-CLEANING CENTRIFUGAL SEPARATOR WITH AUTOMATIC CONTROL

[75] Inventor: Heinrich Hemfort, Oelde, Germany

[73] Assignee: Westfalia Separator AG, Oelde Westphalia, Germany

[22] Filed: Feb. 3, 1976

[21] Appl. No.: 655,041

[30] Foreign Application Priority Data

Feb. 6, 1975 Germany ..... 2504845

[52] U.S. Cl. ..... 233/20 R

[51] Int. Cl.[2] ..... B04B 1/18

[58] Field of Search ..... 233/19 R, 19 A, 20 R, 233/20 A

[56] References Cited

UNITED STATES PATENTS

| | | | |
|---|---|---|---|
| 3,301,476 | 1/1967 | Hemfort | 233/20 R |
| 3,508,704 | 4/1970 | Hemfort | 233/20 R |
| 3,825,176 | 7/1974 | Hemfort | 233/20 R |

*Primary Examiner*—George H. Krizmanich
*Attorney, Agent, or Firm*—Burgess, Dinklage & Sprung

[57] ABSTRACT

Centrifugal separator for separating a specifically lighter component via a discharge passageway (14) therefor, a specifically heavier component via a discharge passageway (5*a*, 10, 11, 13) therefor and collection of a solids component in a solids collecting zone (29). Passageways for discharge of solids are provided at the radial periphery of the drum and valve means are provided for periodically opening of the solids discharge passageways. The invention provides automatic control means for actuation of the valve means for discharging of solids. The control means comprises control fluid passageway (3*a*, 6, 7, 9, 15) having an inlet (3*b*) disposed outwardly of the inlet (5*b*) of the specifically heavier fraction discharge passageway (5*a*), and including a control chamber (7), and bore (15) which conveys the control fluid to the separated specifically heavier fraction for discharge therewith. A pressure switch (17) is exposed to the flowing control fluid and upon interruption of flow of control fluid, due to accumulation of solids at the level of the control fluid passageway inlet (3*b*), the pressure switch actuates control means for opening of the solids discharge passageways.

6 Claims, 2 Drawing Figures

SELF-CLEANING CENTRIFUGAL SEPARATOR WITH AUTOMATIC CONTROL

BACKGROUND

The invention relates to a self-cleaning centrifugal separator with automatic control, in which a small portion of the specifically heavier liquid component is taken from the solids chamber at a point outside of the plate stack and delivered through one or more passages to a centrally disposed control chamber with which there is communicated a device which responds to a diminution or cessation of the incoming flow of liquid by transmitting to a control apparatus the starting pulse for the discharge of the solids and in which the main flow of the specifically heavier liquid is carried away in any desired manner.

A clarifying centrifuge having a control system of this kind is described in German Pat. No. 1,145,100. Clarifying centrifuges are also known in which a sensing liquid is delivered from a central control chamber through one or more passages into the solids chamber in order to sense the level of the solids; see, for example, German Pat. No. 1,173,030.

In both types of centrifuge, the covering of the tubule orifices by solids brings about a displacement of the free liquid level in the central control chamber, whereupon the liquid pressure acting upon the tubule orifices changes and can result in a loss of the seal created by the solids.

To avoid this disadvantage the apparatus described in German Pat. No. 1,227,757 provides for a momentary interruption of the liquid flow, which in that case is an outward flow, in order to give the separated solids time to consolidate into a cohesive layer. However, this does not have any effect on the amount of pressure acting on the plug formed by the solids.

THE INVENTION

The invention is addressed to the problem of designing a centrifugal separator with automatic control such that, when the tubule orifices in the solids chamber become plugged by separated solids, the increase in the liquid pressure acting upon the plug will be greatly restricted.

The separator of the invention is characterized by the fact that the passages serving for the sensing of the level of the solids begin at a greater distance from the axis of rotation than do the passage or passages which carry away the main flow of the specifically heavier liquid, and that regulating disks, which are known in themselves, are disposed as weirs, one below the run-off chamber for the specifically heavier component and the other below the control chamber.

The two regulating disks are matched to one another such that only a very thin film of liquid will pass over the weir into the control chamber. When the feed passages are plugged, it is only this thin film of liquid that will cease to flow, so that the pressure on the plug of solids will remain virtually unchanged.

Figure 1:
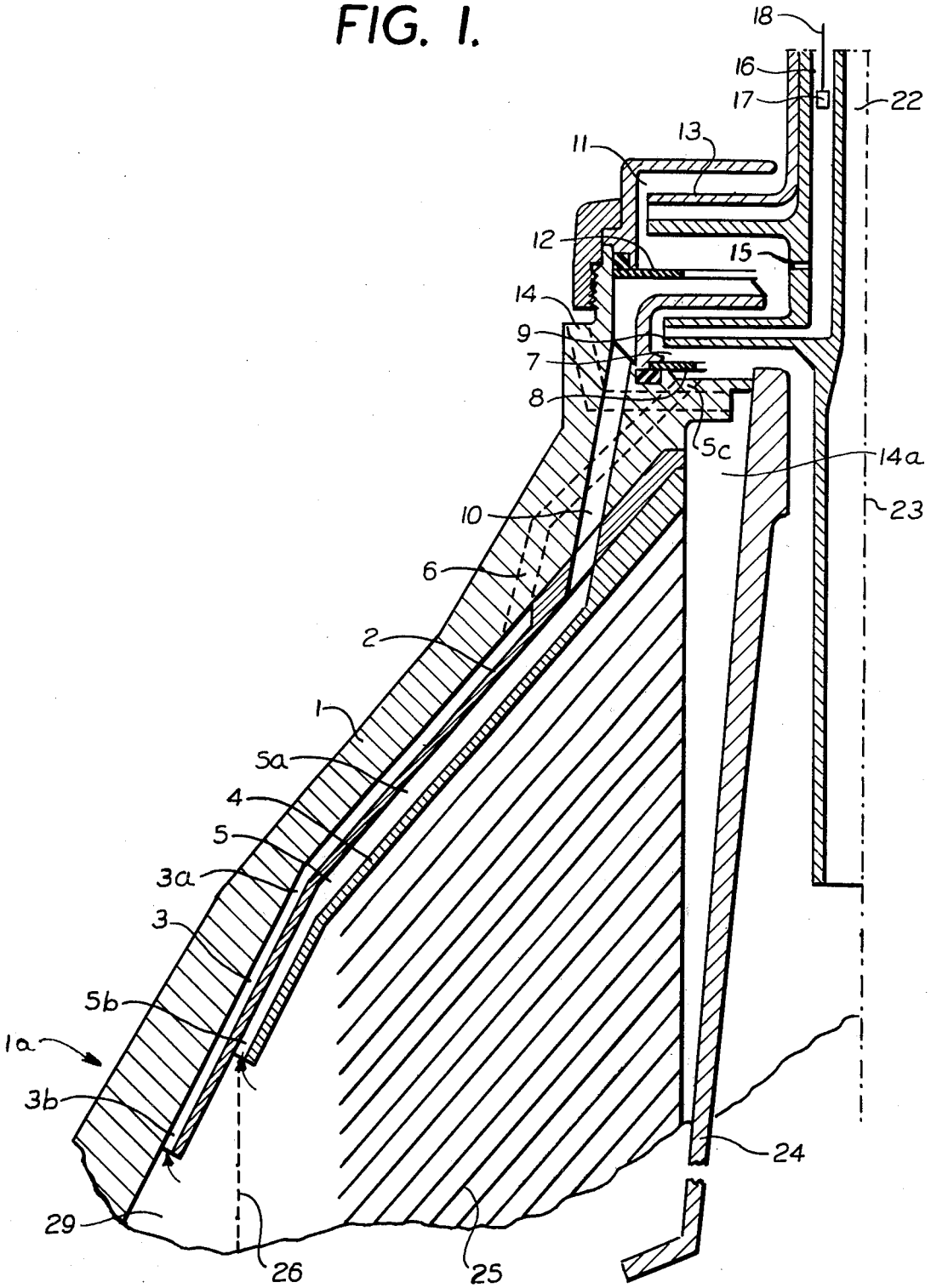
Figure 2:
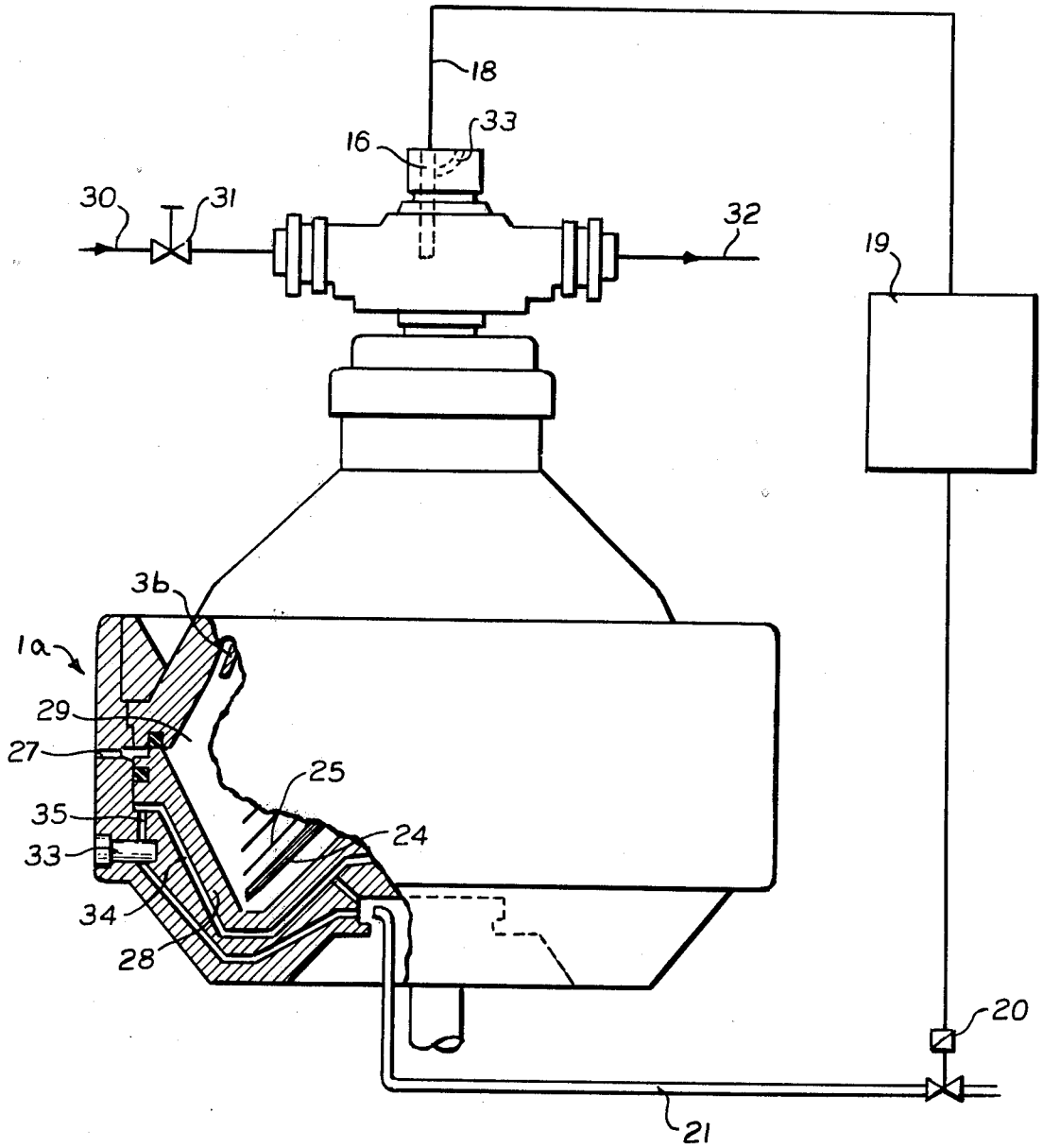

The invention will be better understood from the following description which is with reference to the accompanying drawings, of which:

FIG. 1 is a sectional elevation view of a portion of a separator according to the invention, presenting an embodiment of the novel construction; and FIG. 2 is an elevation view of the separator of FIG. 1, depicting the control system.

Referring to FIG. 1, 1 designates the drum cover, and 2 the insert plate which by means of ribs 3 divides the interstice between the drum cover 1 and the insert plate 2 into a plurality of passages 3*a*. 4 identifies the separating plate which is required in centrifugal separators. It, too, can be provided with ribs 5 dividing the annular space between plates 2 and 4 into a plurality of passages 5*a*. The control liquid withdrawn from the solids chamber passes through the passages 3a and passages 6 into the control chamber 7 by spilling over the inner margin of the weir formed by regulating disk 8. In the embodiment represented, a paring disk 9 is disposed in the control chamber 7 to serve as the pulse producing member.

The main flow of the specifically heavier liquid passes through passages 5*a* and 10 into the run-off chamber 11 by passing over the inner edge of the weir provided by regulating disk 12, and is carried away. In the example, the paring disk 13 conveys the specifically heavier liquid out of the drum under pressure, while the specifically lighter liquid leaves the drum freely through passages 14.

The control liquid entering the control chamber 7 is picked up by the paring disk 9 and delivered through the calibrated bore 15 into the upper run-off chamber 11. As long as liquid flows into the control chamber 7, the passage 16 is under pressure. This passage is connected to a pressure switch 17, which is a component of a control apparatus 18, 19, 20 (FIG. 1 and FIG. 2). When the flow of liquid to the control chamber 7 ceases, the passage 16 becomes free of pressure, and the pressure switch 17 initiates the discharge of the solids.

Due to the communication between chambers 7 and 11, via passageways 6, 3*a*, 5*a*, 10, when the drum is filled and the input is shut off, the free levels of the liquid in the said chambers 7 and 11 establish themselves at the same distance from the axis of rotation, namely at the distance of the inner edge of the regulating disk 12 therefrom.

Upon turning on of the input, a relatively heavy sheet of liquid will pass over the regulating disk 12, which is equivalent to an inward shift of the liquid level, so that despite the smaller inside diameter of the regulating disk 8, a small amount of liquid will pass over it and into the control chamber 7.

The separator of the invention is especially suitable for mixtures of liquids in which the specifically heavier liquid predominates. In such cases, by means of a regulating valve in the input line, the liquid entering the control chamber 7 can be adjusted to a minimal flow.

Thus, with reference to FIG. 1 and FIG. 2, the invention is directed to an improvement in a centrifuge suitable for separation of a mixture of a specifically lighter component, a specifically heavier component and a solids component, into said components. The centrifuge comprises a rotatably mounted, upright hollow drum 1*a* for effecting the separations having a feed inlet means such as feed inlet 22 for introduction of the mixture adjacent the axis 23 of the drum and distribution, via e.g. distributor 24, in the drum for the separation. The drum can have plate stack 25 for facilitating the separation, and has at least one outlet passageway, e.g. 14*a*, 14, for specifically lighter fraction adjacent the drum axis, and at least one outlet passageway, e.g. 5*a*, 10, 11, 13, for specifically heavier component which has an inlet 5*b* communicating with the interior of the drum intermediate the drum axis and the radial periphery of the drum and radially outward of the plate stack 25, for receiving specifically heavier component separated in the drum. The inlet 5*b* serves to define a solids collection zone 29 between the inlet 5*b* and the radial periphery of the drum, i.e. the zone in the drum outwardly of line 26 in FIG. 1. Solids discharge passageway means, which can be outlets 27 (FIG. 2), are disposed at the radial periphery of the drum, and valve means, in the form of, e.g., piston 28, is provided for selectively opening and closing of such as openings 27 for periodic discharge of the solids component. The invention provides the improvement of means for automatically operating the valve means such as 28 for periodic discharge of solids component from the solids collection zone 29, including a control chamber such as 7 disposed adjacent the drum axis, and a control fluid passageway such as 3*a*, 6 having an inlet 3*b* disposed intermediate the inlet 5*b* to the passageway for specifically heavier component and the radial periphery of the drum, and an outlet 5*c* disposed for delivery of the control fluid to the control chamber. Passageway means in the form of e.g. paring disc 9, passage or standpipe, 9, and bore 15, are provided for flow of control fluid out of the control chamber 7 in correspondence with flow of control fluid into the control chamber, so that upon accumulation of solids at the inlet 3*b* of the control fluid passageway, the flow of control fluid is interrupted. Also provided are control means such as are described in detail below, and including flow sensing means which can be the pressure switch 17, for sensing said interruption of flow, and for actuation of the valve means, such as piston 28, to open the solids discharge passageway means such as openings 27 for discharge of the solids, upon occurrence of said interruption.

The control chamber can be paring chamber 7 having a regulating disc 8 providing a weir for flow of control fluid thereover from the control fluid passageway such as 3*a*, 6 into the control chamber. The passageway means for flow of control fluid out of the paring chamber comprises a paring disc 9. The outlet passageway including such as 5*a*, 10, for specifically heavier component can include a run-off chamber disposed adjacent the drum axis, such as paring chamber 11, having a regulating disc 12 providing a weir for flow of specifically heavier fraction thereover into the run-off chamber. The passageway means for flow of control fluid out of the control chamber in the form of such as paring chamber 7, can provide for delivery of the control fluid, via e.g. bore 15, to the run-off chamber such as paring chamber 11.

The run-off chamber 11 is best axially adjacent the control chamber 7 and the regulating disc 12 of the run-off chamber 11 can be disposed between the run-off chamber 11 and the control chamber 7.

The run-off chamber 11 can be disposed over the control chamber 7, and the regulating disc 8 of the control chamber 7 can be on the lower side of the control chamber.

A conduit 30 (FIG. 2) is provided for delivery of feed to feed inlet 22, and a flow regulating valve 31 can be installed in conduit 30. Conduit 32 is provided for discharge of the specifically heavier fraction.

Referring to FIG. 2, when the solids in solids collection zone 29 reaches the inlet 3*b* of passageway 3*a*, 6, the solids plug inlet 3*b*, cutting off flow of control fluid through inlet 3*b*. As the flow diminishes, the pressure switch 17 delivers a starting pulse to a control apparatus 19. The valve 20 in control water feed line 21 is shut, whereupon the outlet valve 33 opens and discharges the liquid, filling closing chamber 34, through the passage 35. The piston 28 moves downwardly under the pressure of the drum charge and the solids are ejected through the openings 27.

At the end of a time preset at the control apparatus 19, valve 20 is opened, the outlet valve 33 closes, the closing chamber 34 fills up again, and the piston 28 moves back to the closed position.

Regarding the inner diameters of the regulating discs, for example, the regulating disc 8 can be from 2 – 8 mm, preferably 3 – 5 mm smaller than the diameter of regulating disc 12.

What is claimed is:

1. In a centrifuge suitable for separation of a mixture of a specifically lighter component, a specifically heavier component and a solids component, into said components, comprising:

a rotatably mounted, upright hollow drum for effecting the separations having a feed inlet means for introduction of the mixture adjacent the axis of the drum and distribution in the drum for the separation, at least one outlet passageway for specifically lighter fraction adjacent the drum axis, at least one outlet passageway for specifically heavier component having an inlet communicating with the interior of the drum intermediate the drum axis and the radial periphery of the drum for receiving specifically heavier component separated in the drum and defining a solids collection zone between the said inlet and the radial periphery of the drum, solids discharge passageway means at the radial periphery of the drum, and valve means for selectively opening and closing of said passageway means for periodic discharge of the solids component the improvement which comprises: means for automatically operating the valve means for periodic discharge of solids component from the solids collection zone, including a control chamber, a control fluid passageway having an inlet disposed intermediate said inlet to the passageway for specifically heavier component and the radial periphery of the drum, and an outlet disposed for delivery of the control fluid to the control chamber, passageway means for flow of control fluid out of the control chamber in correspondence with flow of control fluid into the control chamber, so that upon accumulation of solids at the inlet of the control fluid passageway the flow of control fluid is interrupted, and control means including flow sensing means for sensing said interruption of flow, and for actuation of the valve means to open the solids discharge passageway means for discharge of the solids, upon occurrence of said interruption.

2. Centrifuge of claim 1, wherein:

a. the control chamber disposed adjacent the drum axis is a paring chamber having a regulating disc providing a weir for flow of control fluid thereover from the control fluid passageway means into the control chamber, the passageway means for flow of control fluid out of the paring chamber comprising a paring disc, b. said outlet passageway for specifically heavier component including a run-off chamber disposed adjacent the drum axis and having a regulating disc providing a weir for flow of specifically heavier fraction thereover into the run-off chamber, c. said passageway means for flow of control fluid out of the control chamber being for delivering the control fluid to said run-off chamber.

3. Centrifuge of claim 2, the run-off chamber being axially adjacent the control chamber and the regulating disc of the run-off chamber being disposed between the run-off chamber and the control chamber.

4. Centrifuge of claim 3, the run-off chamber being disposed over the control chamber, and the regulating disc of the control chamber being on the lower side of the control chamber.

5. Centrifuge of claim 1, a conduit for delivery of feed to said feed inlet, and a flow regulating valve in said conduit.

6. Centrifuge of claim 2, the inner diameter of the regulating disc of the control chamber being less than the inner diameter of the regulating disc of the run-off chamber.

* * * * *